US005468063A

United States Patent [19]

Simonek

[11] Patent Number: 5,468,063

[45] Date of Patent: Nov. 21, 1995

[54] ACCESSORIES ORGANIZER

[76] Inventor: Laura M. Simonek, 2240 N. Beckley, Lancaster, Tex. 75134

[21] Appl. No.: 112,956

[22] Filed: Aug. 30, 1993

[51] Int. Cl.[6] ..... A47B 88/00

[52] U.S. Cl. ..... 312/334.28; 312/334.24; 312/287

[58] Field of Search ..... 312/334.24, 334.25, 312/242, 204, 291, 248, 330.1, 283, 287, 324.26, 324.28, 233

[56] References Cited

U.S. PATENT DOCUMENTS

| | | | |
|---|---|---|---|
| D. 289,350 | 4/1987 | Cordero | D6/399 |
| D. 301,812 | 6/1989 | Handler et al. | D6/414 |
| D. 317,380 | 6/1991 | Snyder | D3/75 |
| D. 319,153 | 8/1991 | Powell | D6/440 |
| D. 319,155 | 8/1991 | Powell | D6/448 |
| D. 320,317 | 10/1991 | Powell | D6/440 |
| 2,758,904 | 8/1956 | Hansell et al. | 312/334.24 |
| 2,923,584 | 2/1980 | Broderick | 372/334.25 |
| 4,585,127 | 4/1986 | Benedict | 211/34 |
| 4,723,665 | 2/1988 | Benedict et al. | 211/168 |
| 4,947,987 | 8/1990 | Keenan | 206/292 |
| 5,127,721 | 7/1992 | Inden | 312/242 |

FOREIGN PATENT DOCUMENTS

| | | | |
|---|---|---|---|
| 0358208 | 12/1961 | Switzerland | 312/334.25 |

*Primary Examiner*—James R. Brittain
*Assistant Examiner*—Gerald A. Anderson
*Attorney, Agent, or Firm*—H. Dennis Kelly; Timmons & Kelly

[57] ABSTRACT

A vertical panel is mounted in a cabinet for movement into and out of the cabinet. A plurality of removable accessory holders are attached to the panel for holding accessories. A drawer front is attached to the panel for closing the cabinet when the panel is in the cabinet. The drawer front is attached to the panel along a line that is offset from the midline of the drawer front, to provide more room on one side of the panel for larger accessories. In some embodiments, the panel is a pegboard. The accessories holders include racks for shoes, pegs on which accessories can be hung, or trays for holding rings, earrings, and similar items.

12 Claims, 2 Drawing Sheets

ACCESSORIES ORGANIZER

BACKGROUND OF THE INVENTION

1. Field of the Invention

This invention relates in general to closet organizers. In particular, the invention relates to organizers for holding accessories, such as shoes, belts, ties, necklaces, scarves, and small items, such as rings and earrings.

2. Description of Related Art

Most jewelry boxes are basically boxes with drawers. The drawers are horizontal, and the jewelry is merely placed loose within the drawer or secured within a holder.

Closet organizers have been designed to store shoes and other clothing in a neat and orderly manner. U.S. Pat. No. 4,585,127 to Benedict, discloses a closet organizer that has garment or shoe bags that are mounted on a telescoping or extendable support member. The support member is mounted on the clothing rod in a closet. None of the prior art organizers has a vertical slide-out panel on which accessories can be hung.

Many different types of organizers have been devised for holding ties. Some of these include pegs or rods over which the ties can be hung.

Pegboard has been used for storing many different types of items, such as tools and hardware. A large range of holders have been designed to be attached to pegboard for holding items.

However, the use of pegboard in a closet or accessories organizer has not been tried. The uses of pegboard have generally been limited to mounting on a wall, so that the stored items are hung on the wall, in effect.

SUMMARY OF THE INVENTION

The general object of the accessories organizer of the invention is to store accessories in a compact holder, while providing easy access to the accessories. The organizer has a vertical pegboard panel, mounted for movement into and out of a cabinet.

The panel is attached to a drawer front to close the cabinet when the panel is in the cabinet. The panel is attached to the drawer front along a line that is offset from the midline of the drawer front, to provide more room on one side of the panel for larger items.

A number of different accessories holders are provided for use on the panel. Some holders may be shoe racks for holding shoes, while other holders are pegs for holding ties, belts, necklaces, scarves, and similar items. Other holders may include trays for holding small items, such as rings and earrings.

The above, as well as additional objects, features, and advantages of the invention will become apparent in the following detailed description.

DESCRIPTION OF THE PREFERRED EMBODIMENT

Figure 1:
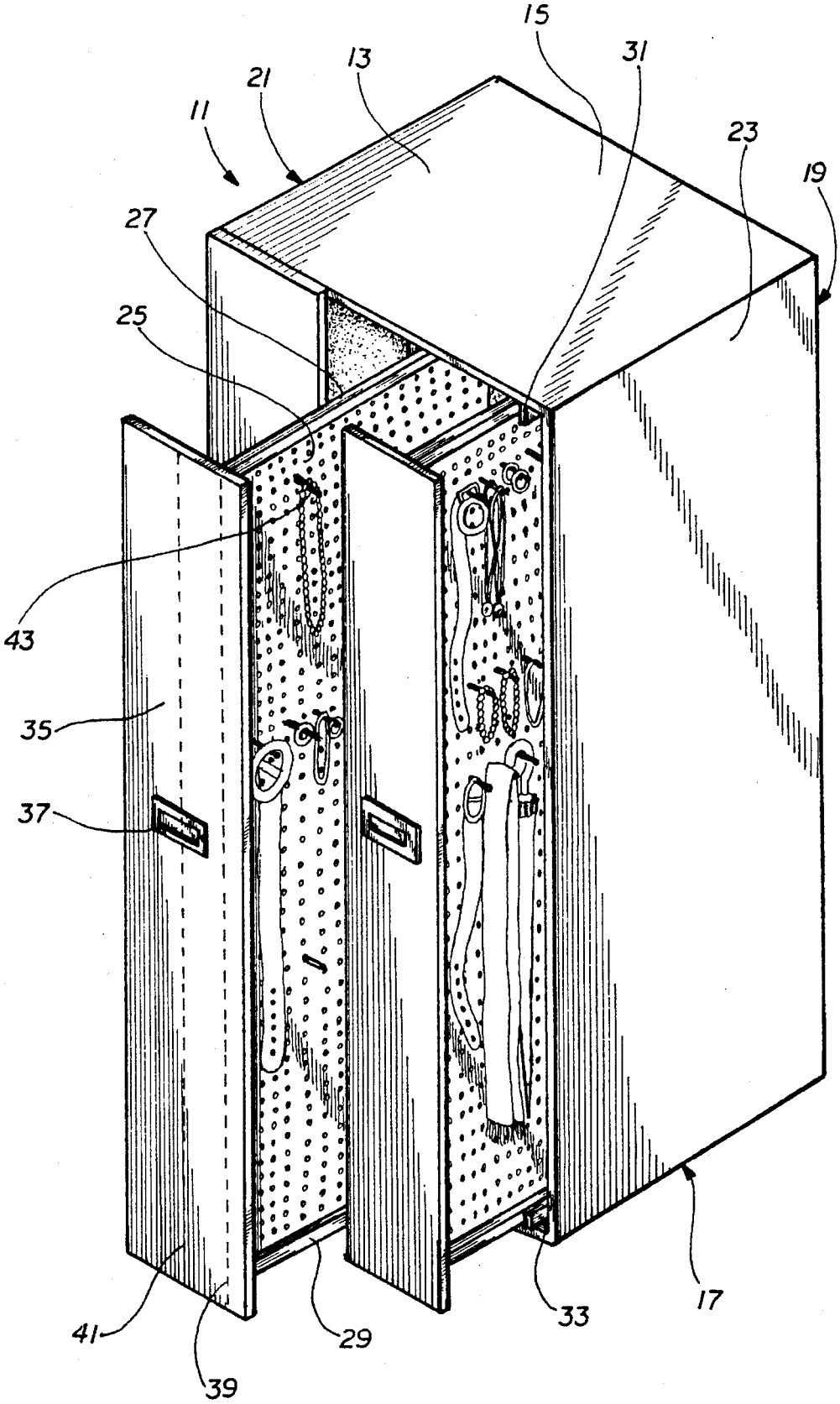
FIG. 1 is a left perspective view of an accessories organizer according to the method of the invention.
Figure 2:
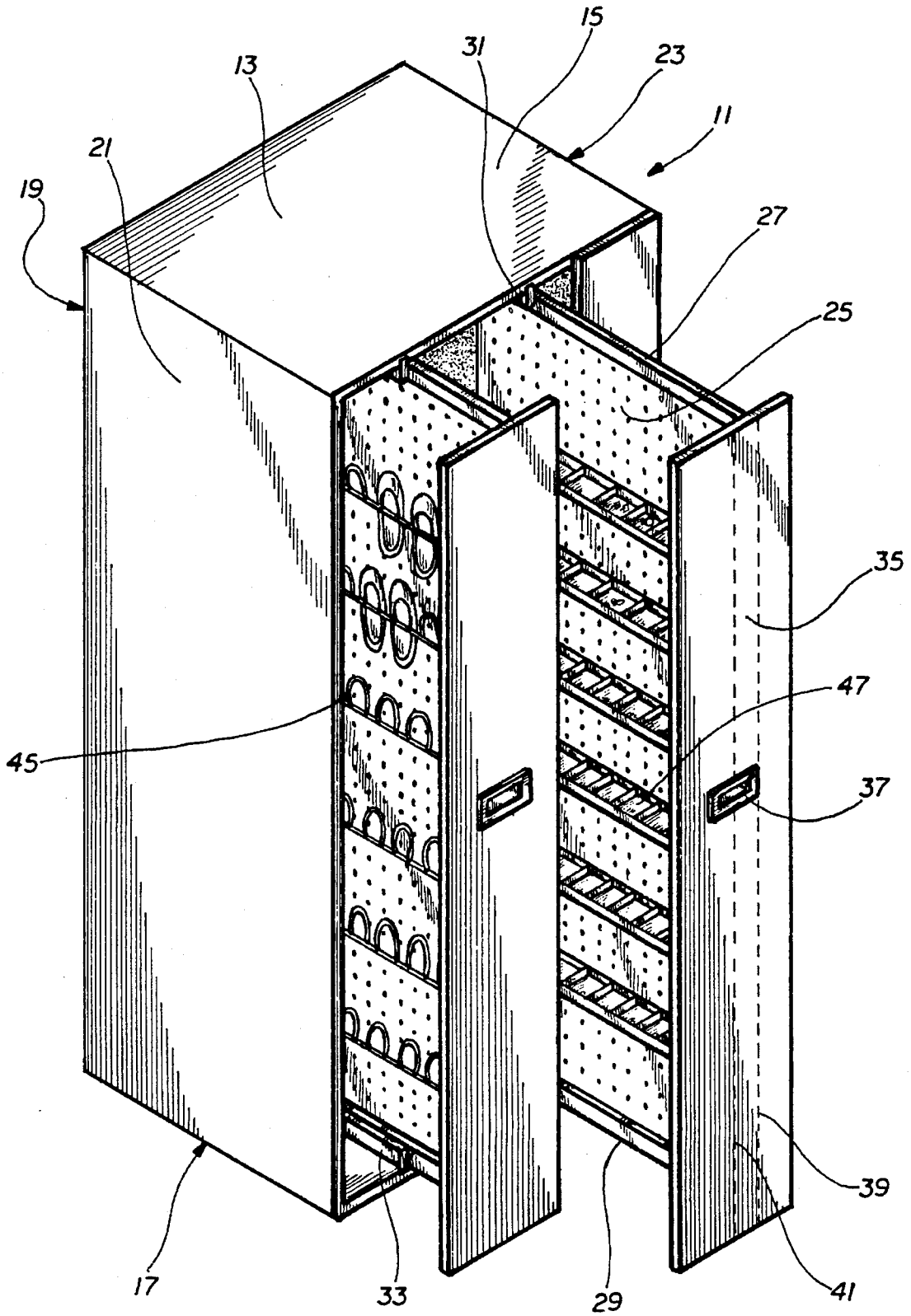
FIG. 2 is a right perspective view of an accessories organizer according to the method of the invention.

The accessories organizer 11 of the invention includes a cabinet 13. The cabinet 13 has a top 15, a bottom 17, a back

19, and two sides 21 and 23. The cabinet 13 may be made of any material that is suitable for furniture.

Three vertical panels 25 are mounted in the cabinet 13. The panels 25 are pegboard, having a plurality of holes. The panels 25 are mounted so that they can be moved into and out of the cabinet 13. The exact method of mounting the panels 25 may vary, but one preferred method is to attach a metal runner 27 to the upper edge of the panel 25 and another runner 29 to the lower edge of the panel 15. The runners 27 and 29 slide along rails 31 and 33 mounted in the cabinet 13.

A drawer front 35 is mounted on the leading edge of each panel 25. The drawer fronts 35 cover and close the front of the cabinet 13 when the panels 25 are in the cabinet 13. The drawer fronts 35 may have handles 37 to facilitate moving the drawer fronts 35.

The panels 25 are attached to the drawer fronts 35 along lines 39 that are offset from the midlines 41 of the drawer front 35. Therefore, there is more room on one side of each panel 25 than on the other. Larger items, such as shoes, can be stored on the larger side of the panel 25, while smaller items, such as ties, can be stored on the other side.

Several different types of accessories holders are available for use with the accessories organizer 11. One type of holder is a simple peg 43. Pegs 43 can be inserted into the pegboard panels 25 in order to hold accessories that can be hung, such as ties, belts, and similar items. The pegs 43 may be staggered to provide an offset from the items hung on the pegs 43 above and below the items.

Another type of holder is a shoe rack 45 for holding shoes. The shoe rack 45 may be used on the larger side of the panel 25 and may hold several pairs of shoes.

A third type of holder is a tray 47 for holding rings, earrings, and similar items. Each tray 47 may have several compartments for holding several different types of items.

The invention has been described in only one embodiment. It should be apparent to those skilled in the art that the invention is not so limited, but is susceptible to various changes and modifications without departing from the spirit of the invention.

I claim:

1. An accessories organizer, comprising:

a cabinet having a back, a top, a bottom, and two sides;

a vertical panel, mounted in the cabinet for movement into and out of the cabinet;

a removable accessory holder, attached to the panel for holding accessories; and a drawer front attached to the panel for closing the cabinet when the panel is in the cabinet, wherein the drawer front is attached to the panel along a line that is offset from both side edges of the drawer front, wherein the drawer front is attached to the panel along a line that is offset from the midline of the drawer front, to provide more room on one side of the panel for larger accessories.

2. An accessories organizer as recited in claim 1, further comprising a plurality of additional accessory holders, wherein all of the accessory holders are removable.

3. An accessories organizer as recited in claim 1, wherein the accessories holders include trays for holding rings, earrings, and similar items.

4. An accessories organizer as recited in claim 1, wherein the panel is a pegboard.

5. An accessories organizer as recited in claim 1, wherein the accessories holders include racks for shoes.

6. An accessories organizer as recited in claim 1, wherein the accessories holders include pegs on which accessories can be hung.

7. An accessories organizer, comprising:

a cabinet having a back, a top, a bottom, and two sides;

a plurality of vertical panels, mounted in the cabinet for movement into and out of the cabinet;

a plurality of accessory holders, attached to the panels for holding accessories; and a plurality of drawer fronts attached to the panels for closing the cabinet when the panels are in the cabinet, wherein each drawer front is attached to a panel along a line that is offset from both side edges of the drawer front, and wherein the drawer fronts are attached to the panels along a line that is offset from the midline of the drawer fronts, to provide more room on one side of the panels for larger accessories.

8. An accessories organizer as recited in claim 7, wherein all of the accessory holders are removable.

9. An accessories organizer as recited in claim 7, wherein the accessories holders include trays for holding rings, earrings, and similar items.

10. An accessories organizer as recited in claim 7, wherein the accessories holders include pegs on which accessories can be hung.

11. An accessories organizer as recited in claim 7, wherein the panels are pegboards.

12. An accessories organizer as recited in claim 7, wherein the accessories holders include racks for shoes.

* * * * *